United States Patent [19]

Hirata

[11] 4,450,581

[45] May 22, 1984

[54] CONVENIENCE CONTAINER WITH CORNERED BOTTOM

[75] Inventor: Isao Hirata, Sagamihara, Japan

[73] Assignee: Tokai Metals Company, Limited, Yokohama, Japan

[21] Appl. No.: 438,726

[22] Filed: Nov. 3, 1982

[30] Foreign Application Priority Data

Nov. 6, 1981 [JP] Japan ..... 56-177258

[51] Int. Cl.[3] ..... B65D 73/02; B65D 85/42

[52] U.S. Cl. ..... 383/42; 383/104; 383/109; 383/151; 206/632

[58] Field of Search ..... 383/104, 121, 42, 109; 206/620, 632, 629, 631; 229/179

[56] References Cited

U.S. PATENT DOCUMENTS

| | | | |
|---|---|---|---|
| Re. 27,838 | 12/1973 | Leasurz et al. | 206/632 |
| 2,445,757 | 7/1948 | Delcher | 383/42 |
| 3,087,668 | 4/1963 | Oler | 383/42 |
| 3,437,258 | 4/1969 | Kugler . | |
| 3,938,731 | 2/1976 | Ross, Jr. et al. | 383/42 |

FOREIGN PATENT DOCUMENTS

| | | | |
|---|---|---|---|
| 637654 | 5/1980 | United Kingdom | 383/42 |
| 637655 | 5/1980 | United Kingdom | 383/42 |

*Primary Examiner*—Joseph Man-Fu Moy

*Attorney, Agent, or Firm*—Cushman, Darby & Cushman

[57] ABSTRACT

A convenience container with a cornered bottom is comprised of an outer shell and a pouch sealed to the inside of the outer shell for containing a liquid. The outer shell is provided with fold lines and with a scored line for forming a mouth opening. The outer shell is pressed inwardly along these fold lines, and the top marginal portion of the outer shell is cut off along the scored line, to thereby easily form an opening to serve as a dispensing mouth.

19 Claims, 16 Drawing Figures

CONVENIENCE CONTAINER WITH CORNERED BOTTOM

BACKGROUND OF THE INVENTION (a) Field of the Invention

The present invention relates to a convenience container with a cornered bottom which is formed with a paper sheet, a plastic sheet, an aluminum foil or their laminated sheet.

(b) Description of the Prior Art

As the containers for being filled with foodstuffs of liquid type, semi-flowable type or powder type and then sealed, cans and bottles are widely known. However, these cans and bottles have problems that their manufacturing cost is high and also in their post-use recovery and disposal.

For these reasons, there have been developed containers using a laminated sheet comprised of, for example, a paper sheet, a plastic film and an aluminum foil, or containers made of a plastic sheet, in place of the above-mentioned cans and bottles. For example, U.S. Pat. No. 3,437,258 discloses a container formed with a plastic sheet for containing a drinkable liquid such as a refreshment liquid. A container of this type is formed with a plastic sheet or a soft laminated sheet, so that the container has a poor shape-holdability, and upon application of an external force, the container easily undergoes a deformation. Especially when the content is a liquid, the container itself which is filled with a liquid will cave in when the container is held by its user's hand. Such type of container is difficult to handle owing to the easy yielding of the walls of the container caused by the flowability and movability of the liquid content. Thus, the container of this type is inconvenient to handle. The container has a further inconvenience in that, when an external force is applied when a straw is penetrated into the container or when an opening for dispensing the content is formed by, for example, scissors, the content is undesirably forced out, spilling the area. Furthermore, because the container per se is easily deformed as stated above, there also arises the problem that it is not easy to materialize automatic collective packaging of a plurality of liquid-stuffed containers.

SUMMARY OF THE INVENTION

It is, therefore, an object of the present invention to provide a convenience container with cornered bottom which substitutes a can or a bottle and which has a good shape-holdability and which allows its dispensing or serving mouth opening to be formed easily.

Other objects of the present invention is to provide a convenience container with cornered bottom comprising a pouch having a cornered bottom and flexible outer shell to which said pouch is bonded, said pouch having a cornered bottom being prepared by folding a sheet material into a W-shape to provide a folds section, sealing left- and right-hand sides of said sheet, respectively, and sealing regions locating between cross points of a single top fold line of the W-shape folds section with the resulting left- and right-hand side seal portions up to two bottom fold lines of said W-shape folds section, respectively, said outer shell having a rectangular shape whose height is substantially equal to a height of said pouch and whose width is somewhat greater than twice of a distance between respective inside edges of the left- and right-hand side seal portions of said pouch, there being provided two fold lines on said outer shell at a distance substantially equal to the distance between respective inside edges of the left- and right-hand side seal portions, there being provided four container-assembling fold lines on the outer shell, when said pouch having a cornered bottom is set onto the outer shell in such way that the inside edges of the left- and right-hand side seal portions of the pouch are in agreement with the two fold lines of the outer shell, so as to extend respectively from a bottom edge of the outer shell in correspondence to cross points of the two bottom fold lines of said pouch and said seal portions of said W-shape folds section, there being provided a first bonding portion on a top marginal portion of the outer shell, there being provided a second bonding portion on a bottom marginal portion of the outer shell, there being provided a cut-off scored line in said first bonding portion to extend as an integral line for an equal distance on both sides of a single fold line, setting said pouch having a cornered bottom to said outer shell in such manner that the two fold lines of the outer shell are in agreement with the inside edges of the left and right side seal portions of the pouch having a cornered bottom, said outer shell being folded along the two fold lines, said pouch having a cornered bottom being bonded to both said first bonding portion and said second bonding portion, then pressing the outer shell at said two fold lines in mutually opposing inward directions, thus folding the outer shell along the four container-assembling fold lines, concurrently therewith, forming said W-shape folds section of the pouch into a cornered bottom, filling, in the above-stated condition of the pouch, this pouch of the container with a content, and sealing a top mouth portion of said pouch having a cornered bottom at a region above said cut-off scored line of the outer shell.

Still other object of the present invention is to provide a convenience container with cornered bottom including at least one opening fold line between two container assembling fold lines provided on both sides of each of said fold lines and said cut-off scored line, whereby an opening to serve as a dispensing mouth is easily formed.

Other objects of the present invention will become apparent by reading the following detailed description in connection with the accompanying drawings.

BRIEF DESCRIPTION OF THE DRAWINGS

FIG. 1 to FIG. 7 show a first embodiment of the convenience container with a cornered bottom according to the present invention, in which:

FIG. 1 is an exploded view of the outer shell of the container;

FIG. 2 is a front elevation of the pouch with a cornered bottom;

FIG. 3 is a front elevation of the container prior to being filled with a content;

FIG. 4 is a perspective view of the container showing state when filled with a content;

FIG. 5 is a perspective view of the container which, in the state shown in FIG. 4, is now provided with a dispensing mouth formation;

FIG. 6 is a perspective view of the container showing another state when it is filled with a content; and FIG. 7 is a perspective view of the container which, in the state shown in FIG. 6, is now provided with a dispensing mouth formation.

FIG. 9 to FIG. 12 show a third embodiment of the container according to the present invention, in which:

FIG. 9 is an exploded view of the outer shell of the container;

FIG. 10 is a front elevation of a pouch having a hexagonal bottom;

FIG. 11 is a front elevation of the container of this embodiment prior to being filled with a content; and FIG. 12 is a perspective view of the container in the state of being filled with a content.

FIGS. 13 and 14 show a fourth embodiment of the container according to the present invention, in which:

FIG. 13 is an exploded view of the outer shell of the container of this embodiment; and FIG. 14 is a front elevation of the pouch having a cornered bottom.

DETAILED DESCRIPTION OF THE PREFERRED EMBODIMENTS

In FIGS. 1 to 7, there is shown a first embodiment of the convenience container with a cornered bottom according to the present invention, and it is comprised of a pouch 1 having a cornered bottom and an outer shell 2 to the inside of which said pouch 1 is to be bonded.

Figure 2:
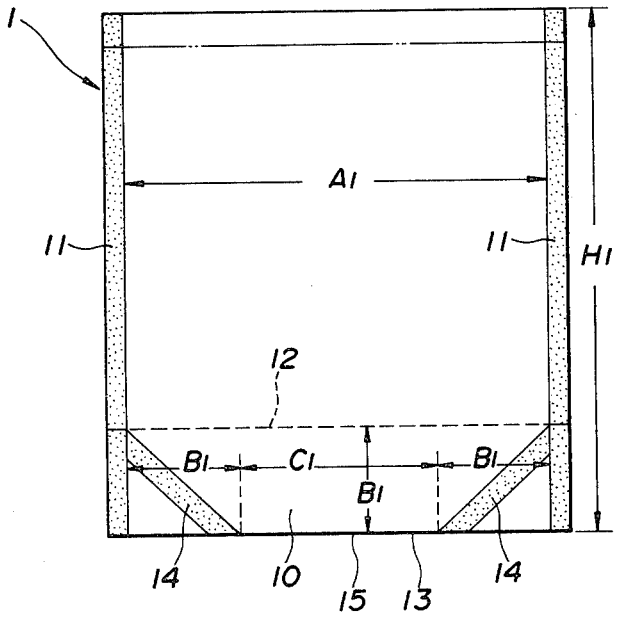
Figure 3:
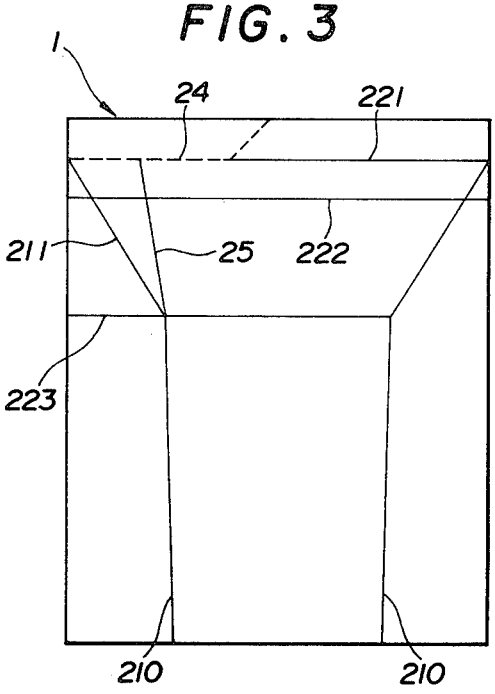

The pouch 1 having a cornered bottom is formed with a single sheet which, in turn, is comprised, as viewed from the inside, of a polyethylene sheet, a paper sheet, a bonding layer and an aluminum foil, or it is comprised of a thin polyethylene film, an aluminum foil, a bonding layer and a paper sheet. This pouch 1 is prepared by folding said single sheet into a W-shape to form a folds section 10, then applying a seal 11 to each of the left- and right-hand sides of the sheet in its developed state, and also applying seals 14, 14 to the portions of said folds section 10 locating between the cross points of two ends of the single top fold line 12 with the two left- and right-hand side seal portions 11, 11 and with the two bottom fold lines 13, 13 of said folds section 10. And, as shown in FIG. 2, the width or distance $C_1$ of the bottom edge 15 defined between the two cross points of said two bottom fold lines 13, 13 with the seal portions 14, 14 of the folds section 10, respectively, is set to be ½ of the width lying between the inside edges of the respective seal portions 11, 11 provided on both left- and right-hand sides of the sheet. Also, the respective widths $B_1$, $B_1$ of the folds as measured from the single top fold line 12 of said folds section 10 up to the two bottom fold lines 13, 13 are made to be equal to the widths $B_1$, $B_1$, respectively, as measured from the two ends of the bottom edge 15 up to the insides of the two side seal portions 11, 11 and also to be ½ of the width $C_1$ of said bottom edge 15, respectively.

Figure 1:
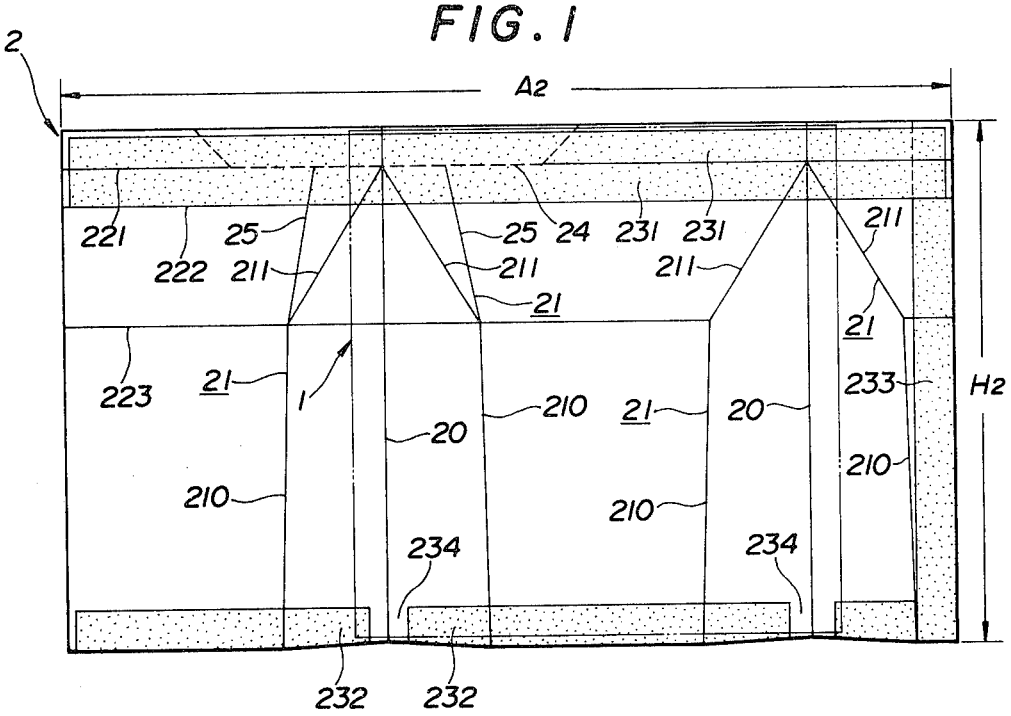

On the other hand, the outer shell 2 is comprised of a flat plate made of a sheet paper or a synthetic resin, and its size is arranged so that its height $H_2$ is equal to the height $H_1$ of the pouch 1 having a cornered bottom, and this pouch has a rectangular shape whose width $A_2$ is somewhat greater than twice the width $A_1$ defined between the inside edges of the left- and right-hand side seal portions 11, 11 of the pouch 1 having a cornered bottom. Two fold lines 20, 20 are provided on this outer shell 2 at a distance therebetween which is substantially equal to the width $A_1$ lying between the inside edges of the left- and right-hand side seal portions 11, 11 of the pouch 1 having a cornered bottom. More particularly, as shown in FIG. 1, a left-hand side fold line 20 is provided on the outer shell 2 at a location which is at a distance 1.5 times the width $C_1$ of the bottom edge 15 of the pouch 1 having a cornered bottom as measured from the edge of the shorter left-hand side of the outer shell 2 in its developed state. A right-hand side fold line 20 is provided on the outer shell 2 at a location which is at a distance of the width $A_1$ defined between the inside edges of the left- and right-hand side seal portions 11, 11 of the pouch 1 having a cornered bottom as measured from the abovesaid left-hand side fold line 20. Four vertical fold lines 21, 21, 21, 21 for assembling the container are provided on the outer shell 2, two of which lying on the left- and right-hand sides of each one of the left- and right-hand two fold lines 20, 20 provided on the bottom edge of the outer shell 2 at distances equal to the widths $B_1$, $B_1$ as measured from the two ends of the bottom edge 15 of the pouch 1 having a cornered bottom to the inside edges of the left- and right-hand side seal portions 11, 11 (½ of the width $C_1$ of the bottom edge 15), in case the pouch 1 having a cornered bottom is set on the outer shell 2 in such a way that the inside edges of the left- and right-hand side seal portions 11, 11 of the pouch 1 are in agreement with the left- and right-hand two fold lines 20, 20 of the outer shell 2.

These container-assembling vertical fold lines 21, 21, 21, 21 are such that each of them is comprised of a main assembling vertical fold line 210 which is provided on the outer shell 2 so as to be inclined progressively toward the fold line 20 as the vertical fold line 210 goes farther from the bottom edge of the outer shell 2 up to about 3/5 of the height $H_2$ of the outer shell 2, and an auxiliary assembling vertical fold line 211 which is provided on the outer shell 2 to extend from the forward end of said main assembling vertical fold line 210 to the fold line 20 located at the marginal portion of the outer shell 2. A first assembling lateral fold line 221 is provided on the upper marginal portion of the outer shell 2 so as to pass through the cross point of said fold line 20 and said auxiliary assembling vertical fold line 211, and a second assembling lateral fold line 222 is provided on the outer shell 2 at a position somewhat below the first assembling lateral fold line 221 so as to be parallel therewith. Furthermore, a third assembling lateral fold line 223 is provided on the outer shell 2 at a location below the second assembling lateral fold line 222 so as to be parallel with said first assembling lateral fold line 221 and also with the second assembling lateral fold line 222, and also to pass through the cross point of the main assembling vertical fold line 210 and the auxiliary assembling vertical fold line 211 of the vertical fold line 21 for assembling the container, and so as to extend from the left side edge of the outer shell 2 up to the cross point of the left side main assembling vertical fold line 210 of the right-hand side fold line 20 and the auxiliary assembling vertical fold line 211. On the portion of the outer shell 2 located above the second assembling lateral fold line 222, there is provided a first bonding portion or strip 231, and a second bonding portion or strip 232 is provided at the bottom edge portion of the outer shell 2, and furthermore a third bonding portion or strip 233 is provided on the right-hand side portion of the outer shell 2, i.e. on that portion located to the right of the extreme right-hand main assembling vertical fold line 210. A non-bonding 234 is provided on the outer shell 2 at the portion where the two left-hand and right-hand fold lines 20, 20 of said second bonding portion 232 are located to prevent the pouch 1 having a cornered bottom from being pulled and drawn in strain when the convenience container having a cornered bottom is assembled. A cut-off scored line 24 is provided in the first bonding portion 231 of the outer shell 2 to extend for an equal distance on both sides of the left-hand side fold line 20 on the first assembling fold line 221. The opposite ends of the cut-off scored line 24 are made to extend up to the top edge of the outer shell 2. A fold line 25 intended for opening the outer shell 2 is provided thereon so as to extend from the cross points of the left- and right-hand side main assembling vertical fold lines 210, 210 and the auxiliary assembling vertical fold lines 211, 211 of the left-hand fold line 20 up to the points on the cut-off scored line 24 located at an equal distance away on both sides of the fold line 20.

Thus, the pouch 1 having a cornered bottom is set onto the outer shell 2 in such way that the two fold lines 20, 20 of the outer shell 2 are in agreement with the inside edges of the left- and right-hand side seal portions 11, 11 of the pouch 1, and the outer shell 2 is folded at these two fold lines 20, 20, and the third bonding portion 233 on the right-hand side portion of the outer shell 2 is bonded to the left-hand portion of the outer shell 2, and furthermore the first bonding portion 231 and the second bonding portion 232 of the outer shell 2 are bonded the upper edge portion and the bottom edge portion of the pouch 1 having a cornered bottom. When the outer shell 2 is folded along the fold lines 20 and 20, the left- and right-hand side seal portions 11, 11 of the pouch 1 having a cornered bottom are folded also at the same time therewith.

Figure 4:
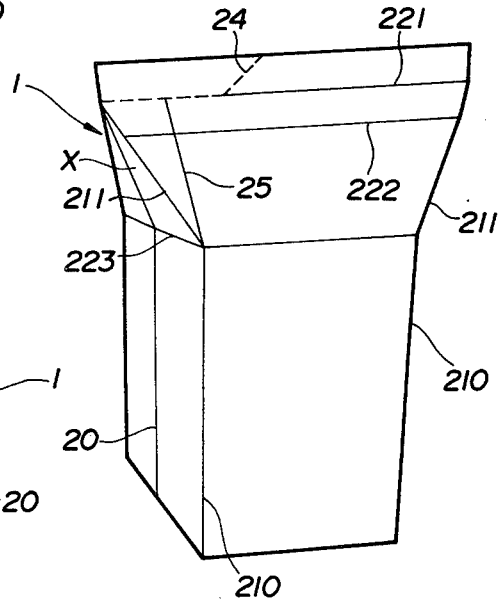

The convenience container having a cornered bottom of this embodiment is of the foregoing arrangement. Therefore, the portions of the two fold lines of the outer shell 2 are pressed in the mutually opposing directions (inwardly) to fold the outer shell 2 along the container-assembling four vertical fold lines 21, 21, 21, 21, i.e. along the main assembling vertical fold lines 210 and the auxiliary assembling vertical fold lines 211 into substantially a quadrilateral columnar shape, and the W-shape folds section 10 of the pouch 1 having a cornered bottom is formed into a four-cornered bottom. In the state wherein the portions of the fold lines 20, 20 of the outer shell 2 are pressed, the pouch 1 having a cornered bottom is filled with a content, and the top edge portion (mouth end portion) of the pouch 1 having a four-cornered bottom is sealed at a location above the first assembling lateral fold line 221 (including the cut-off scored line 24) of the outer shell 2, i.e. at the portion of the outer shell 2 above the two-dots-chain line in FIG. 2, whereby the content can be placed into the pouch 1 and sealed off as shown in FIG. 4. At such time, the four-cornered bottom of the pouch 1 bulges outwardly due to the inner pressure exerted by the content contained therein. Thus, even when the urging pressure applied to the fold lines 20, 20 of the outer shell 2 is removed at the time of assembling the container, the bottom portion of the pouch 1 can be held in its four-cornered shape. Also, the pouch 1 having a cornered bottom which is filled with a content is protected of its external sides by the outer shell 2, and accordingly the container as a whole is made superior in its shape-holdability. Thus, the external configuration of the container will not deform easily, and yet the container is easy to handle, and furthermore it allows an automatic collective packaging of a plurality of filled-up containers in case they are produced on a mass production scale.

Figure 5:
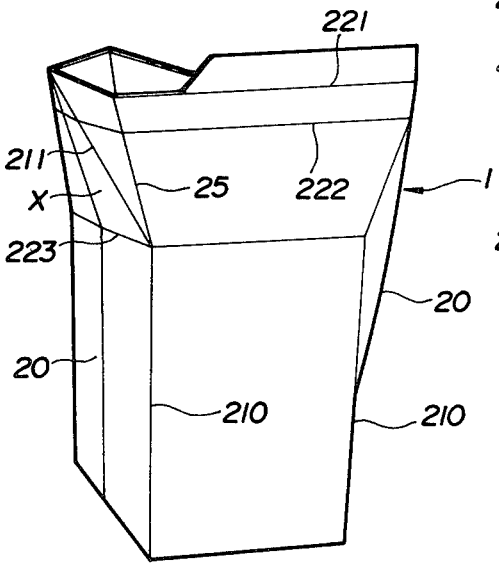
Figure 6:
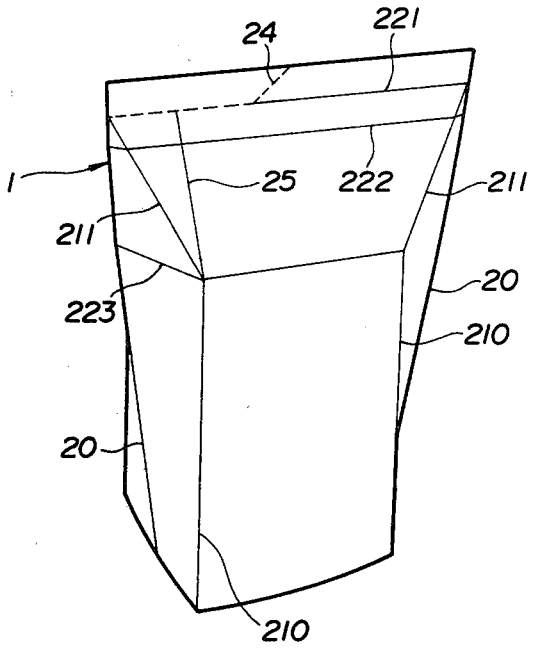
Figure 7:
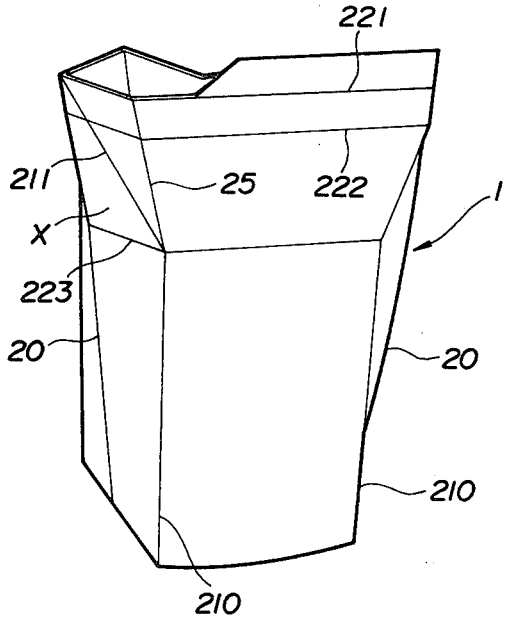

In case it is intended to open the container for getting access to the content thereof, the top marginal portion of the outer shell 2 and the mouth end portion of the pouch 1 having a cornered bottom are cut off at the cut-off scored line 24 as shown in FIG. 5, and the portion above the fold line 20 at the cut-off scored line, i.e. the portion indicated by X in FIGS. 5 and 6, is gently pressed inwardly. Whereupon, the top edge portion of the outer shell 2 is bent along the fold line 25 intended for opening, and thereby it is possible to open the mouth portion of the container easily as in case of opening a can. At such time, since the pouch 1 having a cornered bottom is protected by the outer shell 2 and is imparted thereby a shape-holdability, there is no such fear that, when the container is opened at the mouth portion, the content becomes spilled out due to the external force applied to the pouch 1. It should be noted also that by laminating an aluminum foil onto the surface of the outer shell 2, the dew formation on the surface of the container can be avoided. Also, as shown in FIG. 6, the filling of the container with a content may be performed in such way that the content is placed into the pouch under such condition that the portions of the two fold lines 20, 20 are slightly pressured inwardly or in proximally opposing directions, and the container may be cut off at the cut-off scored line 24 under such slightly pressed state as shown in FIG. 7.

Figure 8:
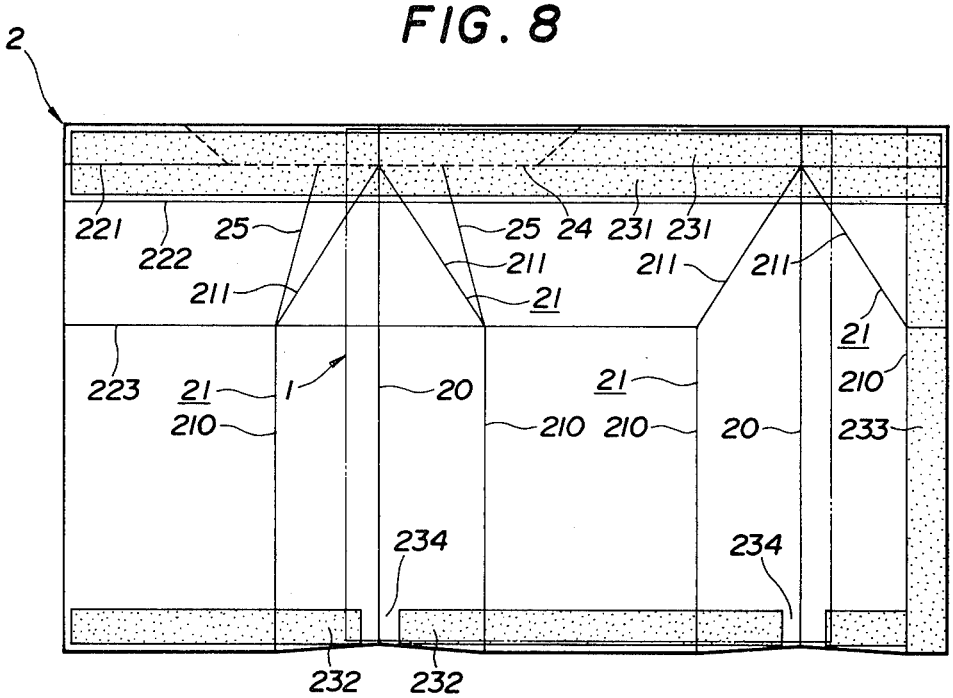
FIG. 8 is an exploded view of the outer shell of the container, showing a second embodiment of the present invention.

FIG. 8 is an exploded view of the outer shell, showing the second embodiment of the convenience container with a cornered bottom according to the present invention. In this embodiment, the outer shell 2 of the main assembling vertical fold line 210 of the container assembling vertical fold line 21 is provided in parallel with the fold line 20.

Figure 9:
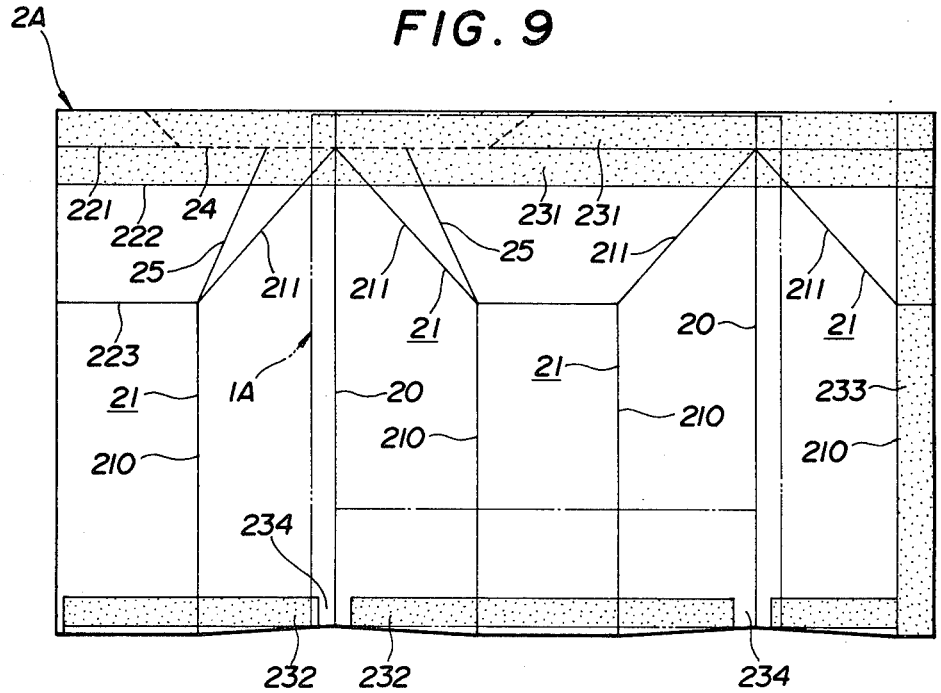
Figure 10:
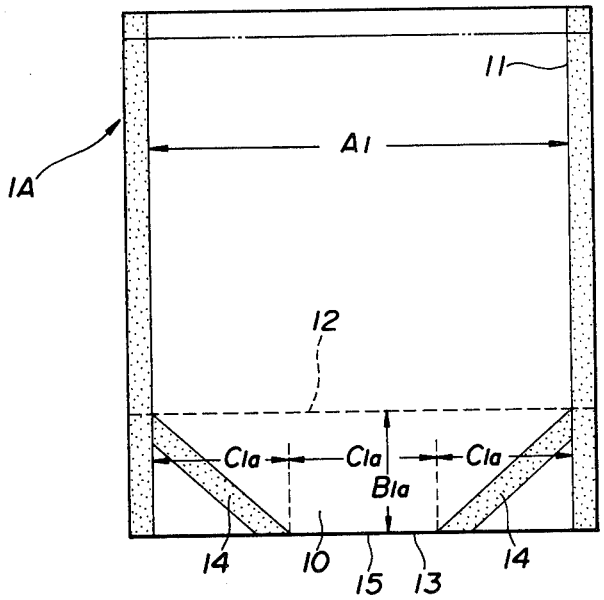
Figure 11:
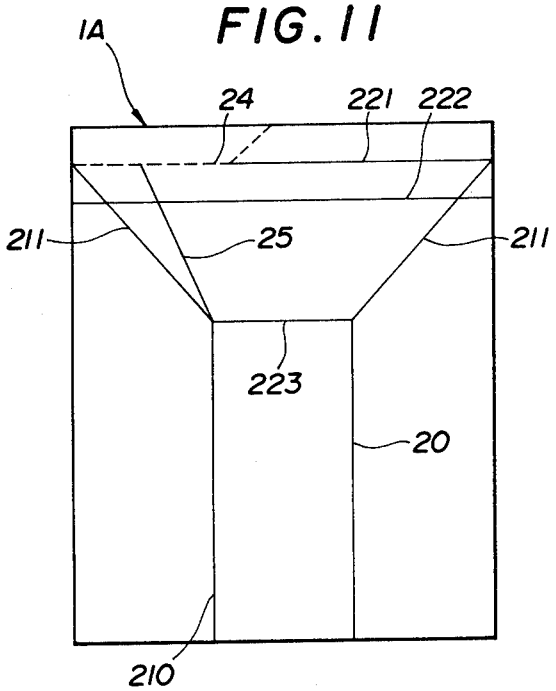
Figure 12:
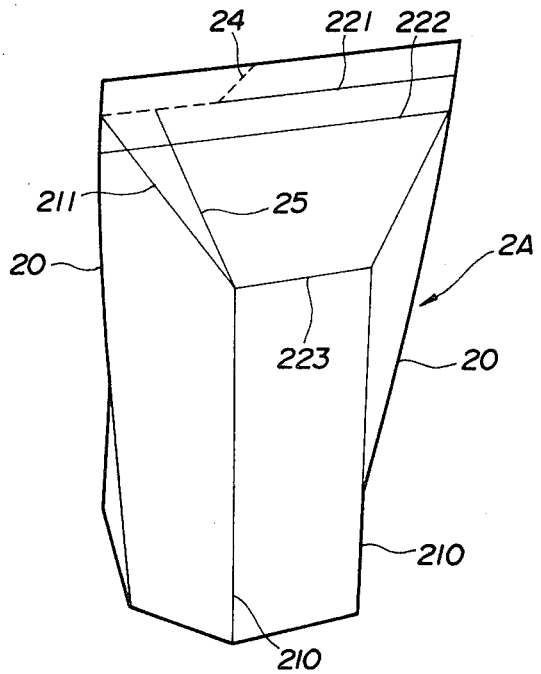

FIGS. 9 to 12 show the third embodiment of the convenience container having a cornered bottom according to the present invention, in which FIG. 9 is an exploded view of the outer shell; FIG. 10 is a front view of the pouch having a hexagonal bottom; FIG. 11 is a front view of the pouch in its flat state prior to being filled with a content; and FIG. 12 is a perspective view in the state of being filled with a content.

The convenience container having a cornered bottom in this embodiment is a convenience container having a hexagonal bottom. It is so arranged dimensionally that the width $B_{1a}$ defined from the top fold line 12 to the bottom fold line 13 of the hexagonal bottomed pouch 1A is set to be $\frac{1}{2}$ of the distance between the two sides which will face each other when the convenience container of the present invention is assembled into a hexagonal configuration, and that the width $C_{1a}$ of the bottom edge 15, as well as the width $C_{1a}$ between the inside edges of the two side seal portions 11, 11 and the cross point of the bottom fold line 13 with the seal portion 14 of the folds section 10 on each side are both set at $\frac{1}{3}$ of the width $A_1$ which is the distance between the left- and right-hand side seal portions 11 and 11. On the other hand, the outer shell 2A has the dimensional arrangement that the width between the fold line 20 and its mating main assembling vertical fold line 210 of the container assembling vertical fold line 21 on each of the left- and right-hand side of the outer shell 2 is set equally to be the width $C_{1a}$ of the bottom edge 15 of the pouch 1A having a hexagonal bottom.

Figure 13:
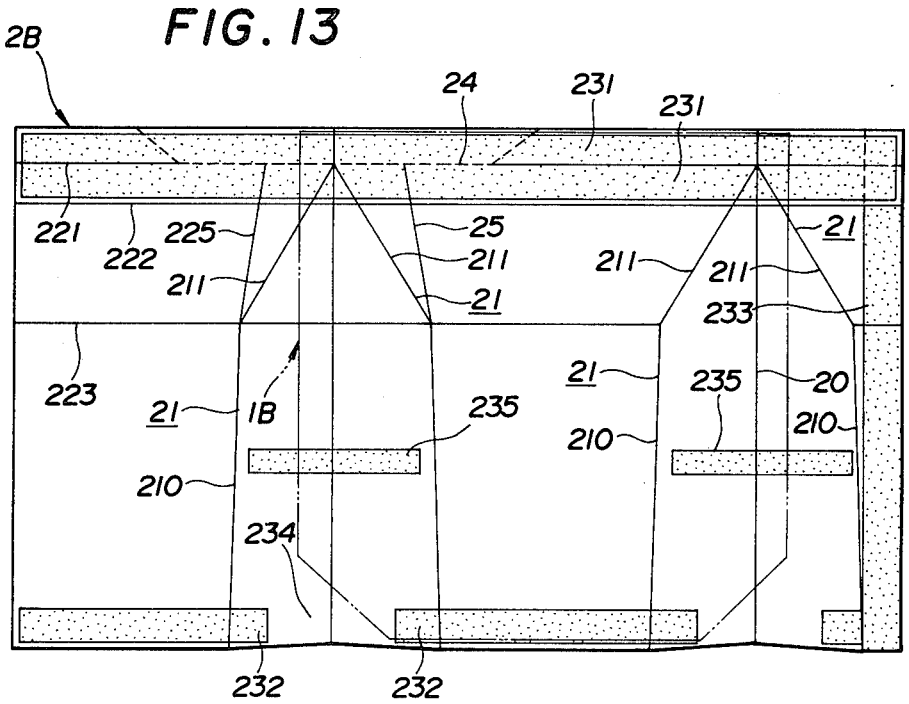
Figure 14:
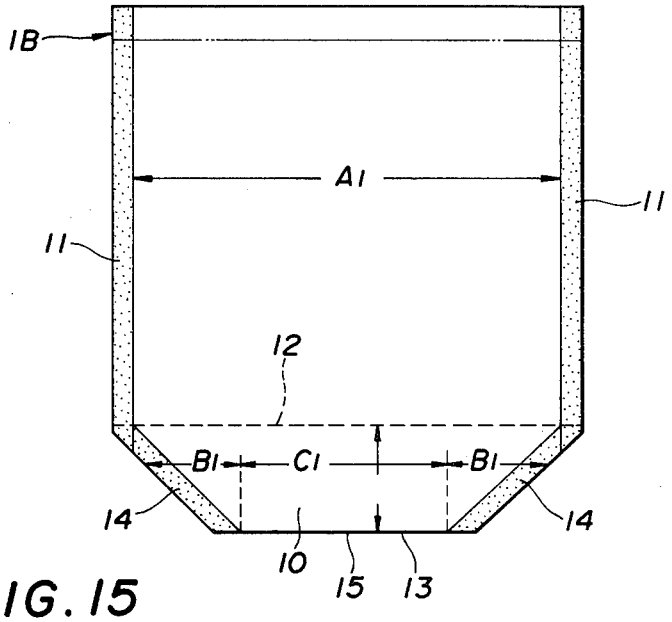
Figure 15:
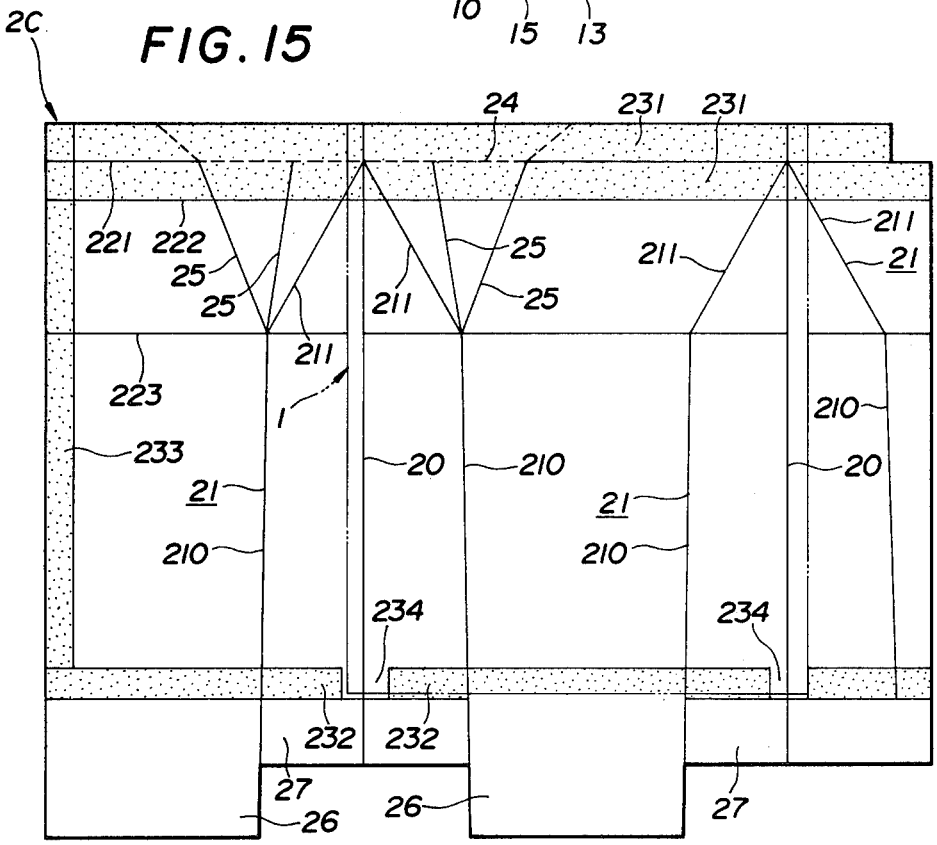
FIG. 15 is an exploded view of the outer shell showing a fifth embodiment of the container according to the present invention.

FIGS. 13 and 14 show the fourth embodiment of the convenience container having a cornered bottom, in which: FIG. 13 is an exploded view of the outer shell, and FIG. 14 is a front view of the pouch having a cornered bottom.

The convenience container with a cornered bottom according to the present invention is arranged so that the both corner portions at the folds sections 10, 10 of the pouch 1B having a cornered bottom are removed, and that the width of the non-bonding portion 234 of the third bonding portion 232 of the outer shell 2B is made equal to the width of the bottom edge 13 of the pouch 1B having a cornered bottom, and that there is provided a fourth bonding portion 235 at a site slightly below the intermediate portion of the outer shell 2B and extending to both sides of the fold line 20 on the left- and right-hand sides of the outer shell.

FIG. 14 is an exploded view of the outer shell showing the fifth embodiment of the convenience container having a cornered bottom according to the present invention. The outer shell 2C of this embodiment is such that the bottom edge portion 27 is made to extend downwardly to some distance, and that the bottom edge portion located between the extremely left side edge to the container-assembling vertical fold line 21 which is on the left side of the left-hand fold line 20 of the outer shell 2C, and also the bottom edge portion located between the container assembling vertical fold line 21 located on the right side of the right-hand side fold line 20 to the container assembling vertical fold line 21 located on the left side of the right-hand side fold line 20 are made to extend for a distance to form bottom portions 26 and 26, respectively.

Figure 16:
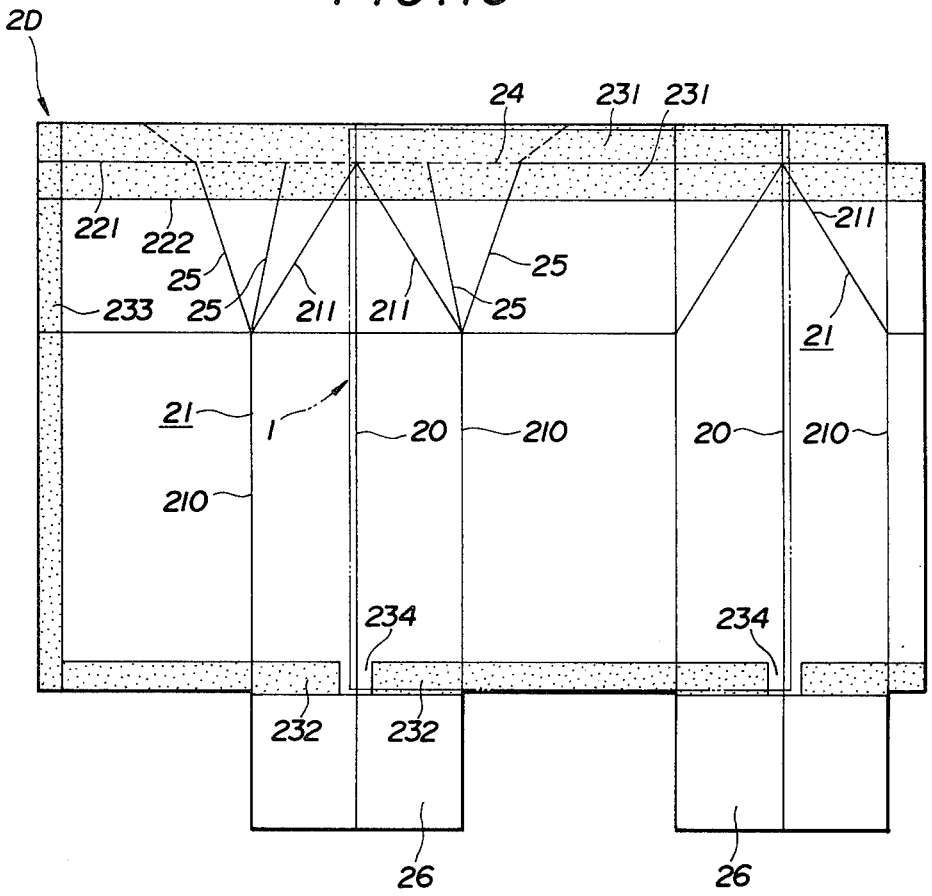
FIG. 16 is an exploded view of the outer shell of the container showing a sixth embodiment of the present invention.

FIG. 16 is an exploded view of the outer shell indicative of the sixth embodiment of the convenience container with a cornered bottom according to the present invention. In this embodiment, the bottom edge portion which is located between the container assembling vertical fold line 21 provided on the right-hand side of the left-hand side folding line 20 of the outer shell 2D, and also the bottom edge portion which is located between the container assembling vertical fold line 21 provided on the left-hand side of the right-hand side fold line 20 to the container assembling vertical fold line 21 provided on the right-hand side are both extended to provide respective bottom portions 26 and 26.

The convenience containers shown in this instant embodiment and in the preceding embodiment are such that their bottoms are formed with the bottom portions 26, 26 of the outer shells 2C and 2D, respectively. Therefore, these containers have a further improved shape-holdability, and also the cornered bottom of the pouch can be protected.

In the respective embodiments described above, cut-off scored lines 24, 24 which are in fact an integral line are provided to extend for a same distance on each side of the left-hand side fold line 20 so as to run on the first assembling fold line 221 in the first bonding portion 231 of the outer shell 2, and furthermore the two ends of the cut-off scored line 24 are extended, forming a slight curve, up to the top edge of the outer shell 2. It should be understood, however, that the cut-off scored line 24 may be formed throughout the entire fold line 221.

Also, in each of the respective embodiments described above, the pouch may be arranged so that the side edge portion of the pouch located on that side where the opening is formed is bent to turn into double form and that this superposingly bent portion and the body wall of the pouch are bonded each other at a site near the top edge of the pouch. By so constructing the clearance between the pouch which is bonded to the outer shell and the bend portion can be reduced further, so that, when the content liquid is drunk by the user through the opening, the fear that the content leaks out through the clearance can be eliminated altogether.

Though a matter of course, the convenience container with a cornered bottom according to the present invention is not limited to those embodiments described above.

What is claimed is:

1. A method for making a convenience container having a cornered bottom, comprising:

(a) forming a pounch by:

(i) providing a generally rectangular blank of flexible pouch material, and folding that blank into the form of a pouch that is medially W-shaped in vertical cross-sectional shape, along three substantially parallel, laterally extending lines so as to superimpose both ends of the blank along the upper margin of the pouch form and so as to dispose the central one of the three fold lines as a single top fold line located intermediate the height of the pouch form and the other two of the three fold lines as two bottom fold lines located at the bottom edge of the pouch form, thereby defining an outer front panel, an inner front panel, an inner rear panel and an outer rear panel; all four of these panels having superimposed left margins and superimposed right margins although the left and right margins of said inner panels are not as tall as the left and right margins of said outer panels;

(ii) sealing the left margins of said outer panels to one another therealong above said single top fold line and sealing the right margins of said outer panels to one another therealong above said single top fold line;

(iii) sealing the outer front panel to the inner front panel at the left and at the right, and the outer rear panel to the inner rear panel at the left and at the right, along four respective oblique lines each running obliquely upwardly generally from the bottom edge of the pouch form from a point substantially short of half way across the width of the pouch form, to the respective side margin of the pouch form;

(b) forming a blank for a flexible outer shell for the pouch by:

(i) providing a generally rectangular blank of flexible outer shell material having a height which is substantially equal to the height of said pouch, and a width which is somewhat greater than twice the lateral distance across said pouch neglecting the sealed side margins of the pouch;

(ii) providing two substantially vertical fold lines on said rectangular blank flexible outer shell material intermediate the width of said rectangular blank, these two fold lines being laterally spaced from one another by a distance which is substantially equal to the lateral distance across said pouch neglecting the sealed margins of the pouch;

(iii) defining three bonding strips on said rectangular blank of flexible outer shell material, including a first one extending laterally along the upper margin thereof, a second one extending laterally along the lower margin thereof, and a third extending vertically along one side margin thereof;

(c) assembling the pouch with a flexible outer shell, (i) superimposing said pouch upon said rectangular blank of flexible outer shell material so that the bottom edge of the pouch is superimposed on the second bonding strip, the sealed left margin of the pouch lies to the left of the leftmost one of said two substantially vertical fold lines, the sealed right margin of the pouch lies to the right of the rightmost one of said two substantially vertical fold lines, and the upper margin of the outer rear panel of the pouch is superimposed on the first bonding strip;

(ii) activating the first, second and third bonding strips; and (iii) sequentially doubling over said rectangular blank of flexible outer shell material along said two substantially vertical fold lines, so as to perimetrically enclose said pouch with said rectangular blank of flexible outer shell material, bond said pouch to said blank along said first and second bonding strips and bond said rectangular blank of flexible outer shell material to itself along said third bonding strip, (iv) providing four generally vertical container-assembling fold lines on said rectangular blank of flexible outer shell material, each extending upwards from the bottom edge of said rectangular blank of flexible outer shell material at a given lateral distance respectively to the left or the right of one or the other of said two substantially vertical fold lines laterally to the vicinity of said first bonding strip, said given distance being substantially equal to the lateral distance from where each of said four respective oblique lines intersects the bottom edge of said pouch at the respective said point, to the respective sealed side margin of the pouch, neglecting the width of the respective sealed side margin of the pouch, and thereby defining a generally flat fronted/flat backed, open topped/closed bottomed article which may be filled through its open top, in connection with medially bulging its front and back away from one another along said four generally vertical container-assembling fold lines and moving said two substantially vertical fold lines laterally towards one another at least below said first bonding strip, and bulging the bottom of the pouch centrally downwards along said single top fold line to provide a generally flat, cornered bottom of the pouch.

2. The method of claim 1, further including:

(d) medially bulging the front and back of said generally flat article away from one another along said four generally vertical container-assembling fold lines and moving said two substantially vertical fold lines laterally towards one another at least below said first bonding strip, and bulging the bottom of the pouch centrally downwards along said single top fold line to provide a generally flat cornered bottom of the pouch.

3. The method of claim 2, further including:

(e) filling the pouch; and (f) sealingly closing the top of said pouch.

4. The method of claim 3, further including:

providing a scored line in said first bonding strip so as to cross and laterally extend substantially equal distances to the left and right of one of said two substantially vertical fold lines; and wherein, in conducting step (f), the top of said pouch is sealed along a line which lies above said scored line for at least part of the lateral extent thereof, so that said convenience container, once filled and sealed, may be opened by cutting along said scored line.

5. A generally flat fronted/flat backed, open topped/closed bottomed article produced by the process of claim 1.

6. A bulged, filled and sealed convenience container produced by the process of claim 3.

7. A generally flat fronted/flat backed, open topped/closed bottom article which may be folded and bulged, filled and sealed to provide a closed container of contents, with a cornered bottom, said article comprising:

a flexible pouch of flexible pouch material which, medially, is W-shaped in vertical cross section so as to have an outer front panel, an inner front panel joined to the outer front panel along a first bottom fold line, an inner rear panel joined to the inner front panel along a single top fold line, and an outer rear panel joined to the inner rear panel along a second bottom fold line; all four of these panels having superimposed left margins and superimposed right margins, although the left and right margins of said inner panels are not as tall as the left and right margins of said outer panels;

means sealing the left margins of said outer panels to one another therealong above said single top fold line, and sealing the right margins of said outer panels to one another therealong above said single top fold line;

means sealing the outer front panel to the inner front panel at the left and the outer rear panel to the inner rear panel at the left and at the right, along four respective oblique lines each running obliquely upwardly generally from the bottom edge of the pouch from a point substantially short of half way across the width of the pouch form, to the respective side of the form;

a flexible outer shell comprising a generally rectangular blank of flexible outer shell material having a height which is substantially equal to the height of said pouch, and a developed width which is somewhat greater than twice the lateral distance across said pouch neglecting the sealed side margins of the pouch;

means providing two substantially vertical fold lines on said rectangular blank flexible outer shell material intermediate the width of said rectangular blank, these two fold lines being laterally spaced from one another by a distance which is substantially equal to the lateral distance across said pouch neglecting the sealed margins of the pouch;

means defining three bonding strips on said rectangular blank of flexible outer shell material, including a first one extending laterally along the upper margin thereof, a second one extending laterally along the lower margin thereof, and a third extending vertically along one side margin thereof;

said blank of flexible outer shell material having said pouch superimposed thereupon and assembled therewith so that the bottom edge of the pouch is superimposed upon the second bonding strip, the sealed left margin of the pouch lies to the left, in development, of the leftmost one of said two substantially vertical fold lines, the sealed right margin of the pouch lies to the right, in development, of the rightmost one of said two substantially vertical fold lines, and the upper margin of the outer rear panel of the pouch is superimposed on the first bonding strip;

said rectangular blank of flexible outer shell material is doubled over upon itself, lapwise, along said two substantially vertical fold lines so as to perimetrically enclose said pouch with said rectangular blank of flexible outer shell material;

said pouch being bonded along the front and rear panels thereof to said rectangular blank of flexible pouch material by said first and second bonding strips and said rectangular blank of flexible outer shell material being bonded to itself by said third bonding strip;

means providing four generally vertical container-assembling fold lines on said rectangular blank of flexible outer shell material, each extending upwards from the bottom edge of said rectangular blank of flexible outer shell material at a given lateral distance respectively to the left or the right of one or the other of said two substantially vertical fold lines, to the vicinity of said first bonding strip, said given distance being substantially equal to the lateral distance from where each of said four respective oblique lines intersects the bottom edge of said pouch at the respective said point, to the respective sealed side margin of the pouch, neglecting the width of the respective sealed side margin of the pouch, and thereby defining a generally flat fronted/flat backed, open topped/closed bottomed article which may be filled through its open top, in connection with medially bulging its front and back away from one another along said four generally vertical container-assembling fold lines and moving said two substantially vertical fold lines laterally towards one another at least below said first bonding strip, and bulging the bottom of the pouch centrally downwards along said single top fold line to provide a generally flat, cornered bottom of the pouch.

8. The article of claim 7, further including:

means providing a scored line in said first bonding strip so as to cross and laterally extend substantially equal distances to the left and right of one of said two substantially vertical fold lines; and the top of said pouch being constructed and arranged to be sealed along a line which lies above said scored line for at least part of the lateral extent thereof, so that said convenience container, once filled and sealed, may be opened by cutting along said scored line.

9. The article of claim 8, further including:

two additional fold lines rising correspondingly oppositely obliquely towards proximity with said one of said two substantially vertical fold lines at said scored line from a common intermediate level, for aiding in pouring contents from the convenience container after it has been opened by cutting along said scored line.

10. The article of claim 9, wherein:

each of said four generally vertical container-assembling fold lines are divided into a respective two segments at said common intermediate level, including a lower, more nearly vertical segment and an upper more obliquely-oriented segment which intersects with said one of said two substantially vertical fold lines at said scored line.

11. The article of claim 10, further including:

a first lateral fold line extending across the developed width of the rectangular blank of flexible shell material at a level substantially corresponding to that of said scored line; and a second lateral fold line extending at said common intermediate level across the developed width of the rectangular blank of flexible shell material at least throughout all of such width except for between the two of said four generally vertical container-assembling fold lines which oppositely adjoin the other of said two substantially vertical fold lines.

12. The article of claim 11, wherein:

said scored line includes in addition to a laterally extending segment crossing said one of said two substantially vertical fold lines, an oblique segment joined with said laterally extending segment and extending to the top edge of said flexible shell.

13. The article of claim 7, wherein:

the width of said pouch laterally between where respective pairs of said four respective oblique lines intersect the respective bottom fold lines being substantially equal to one-half the developed width of said pouch, neglecting the sealed margins of said pouch; and the height of said front and rear inner panels of said pouch is equal to one-fourth the developed width of said pouch, neglecting the sealed margins of said pouch.

14. The article of claim 7, wherein:

said fourth generally vertical container-assembling fold lines are substantially parallel to the two substantially vertical fold lines.

15. The article of claim 7, wherein:

the width of the pouch laterally between where respective pairs of said four respective oblique lines intersect the respective bottom fold lines being substantially equal to one-third the developed width of said pouch, neglecting the sealed margins of said pouch, whereby the closed container which may be folded, bulged, filed and sealed therefrom is hexagonally bottomed.

16. The article of claim 7, wherein:

said second bonding strip is discontinuous widthwise of the developed rectangular blank of flexible shell material and particularly is missing on and laterally immediately adjacent both of said two substantially vertical fold lines.

17. The article of claim 16, further including:

means defining a fourth bonding strip on said substantially rectangular blank of flexible shell material, extending laterally thereon at a level intermediate said first and second bonding strip means and above where said four respective oblique lines intersect the side margins of said pouch, this fourth bonding strip means extending laterally throughout where said second bonding strip is missing.

18. The article of claim 7, wherein:

said pouch if obliquely cut-off at its laterally opposite lower corners below said four respective oblique lines.

19. The article of claim 7, wherein:

said substantially rectangular blank of flexible shell material further includes lower marginal flap portions constructed and arranged to be folded under and associated together to provide a shape-holding bottom for underlying the pouch.

* * * * *